US007673364B2

(12) United States Patent
Dombrowski

(10) Patent No.: US 7,673,364 B2
(45) Date of Patent: Mar. 9, 2010

(54) GARBAGE DISPOSAL COMBINATION SAFETY POKER AND SCRAPER

(75) Inventor: Thomas K Dombrowski, Elk Grove, IL (US)

(73) Assignee: Disposal Guard Inc., Elk Grove Village, IL (US)

( * ) Notice: Subject to any disclaimer, the term of this patent is extended or adjusted under 35 U.S.C. 154(b) by 839 days.

(21) Appl. No.: 11/533,797

(22) Filed: Sep. 21, 2006

(65) Prior Publication Data

US 2008/0072387 A1 Mar. 27, 2008

(51) Int. Cl.
*A47K 1/14* (2006.01)

(52) U.S. Cl. ..... 15/105; 4/286; 4/295

(58) Field of Classification Search ..... 15/105; 4/255.11, 287, 295, 286, 293; 81/488; D32/35, D32/40, 42, 46–49; *A47K 1/14*
See application file for complete search history.

(56) References Cited

U.S. PATENT DOCUMENTS

| | | | | |
|---|---|---|---|---|
| D269,302 | S | | 6/1983 | Auerbach |
| 4,395,792 | A | | 8/1983 | Cosner |
| 4,409,692 | A | | 10/1983 | Ness |
| 4,504,996 | A | | 3/1985 | Loos |
| RE32,141 | E | | 5/1986 | Cosner |
| 5,265,281 | A | * | 11/1993 | McAlpine ..... 4/287 |
| 5,473,782 | A | | 12/1995 | Coakley |
| 5,488,749 | A | | 2/1996 | Pearce et al. |
| D375,434 | S | | 11/1996 | Roussel |
| 5,617,605 | A | | 4/1997 | Hoerner et al. |
| 5,636,390 | A | * | 6/1997 | Strech ..... 4/295 |
| D398,104 | S | | 9/1998 | Raines |
| 6,192,525 | B1 | | 2/2001 | Tash |
| D457,279 | S | | 5/2002 | Ingram et al. |
| 6,718,852 | B1 | | 4/2004 | Bickel et al. |

* cited by examiner

*Primary Examiner*—Monica S Carter
*Assistant Examiner*—Stephanie Newton
(74) *Attorney, Agent, or Firm*—Miller Matthias & Hall

(57) ABSTRACT

An improved combination garbage disposal safety poker and scraper for scraping waste from eating ware and sinks and pushing such materials into the disposal unit so that such wastes are close as possible to the blades of the disposal. The safety poker/scraper has interchangeable tops which may consist of a cup-shaped drain and handle, an elastomeric cap and handle or simply an enlarged handle. The scraper portion is detachable and can be replaced when worn. The scraper portion is curved so that it can fit more easily into the garbage disposal unit.

4 Claims, 2 Drawing Sheets

GARBAGE DISPOSAL COMBINATION SAFETY POKER AND SCRAPER

BACKGROUND

1. Field of the Invention

This patent relates to a combination garbage disposal safety poker and scraper.

2. Description of the Related Art

Heretofore combination garbage disposal pokers and scrapers have not included curved scrapers that extend from the end of the cylindrical necks from a flared portion of the neck. They have also not included interchangeable handles and drains. Further, prior scrapers/pokers have not included detachable scrapers that can be replaced when they are worn out.

Thus it is an object of the present invention to provide a curved scraper that can fit more easily into the disposal unit for scraping and poking. It is also an object of the present invention to include interchangeable handles and drains and a detachable scraper that can be replaced.

Further and additional objects will appear from the description, accompanying drawings, and appended claims.

SUMMARY OF THE INVENTION

The present invention is a combination garbage disposal poker and scraper to be used with a sink drain mounted garbage disposal unit. The poker/scraper has a neck with a top end and a bottom end. The bottom end has a detachable flared portion with a curved scraper attached to the flared portion. The top end has interchangeable handles and drains. The top end can have a cap between the neck and the handle with the cap capable of forming a fluid tight seal over the sink drain; a cup-shaped drain disposed between the neck and the handle, the drain capable of forming a fluid-tight seal if the drain is twisted so that the holes of the drain are blocked by a piece of metal that rests under the drain; or an enlarged handle without a cap or drain. The curved scraper portion of the device has a degree of curvature of between about 90 and about 180 degrees. The curved scraper portion may be detachably affixed to the flared portion.

THE DRAWINGS

FIG. 1 also shows an example splash guard of a sink mounted garbage disposal and waste items that are being scraped into the disposal.

DETAILED DESCRIPTION OF THE INVENTION

Figure 1:
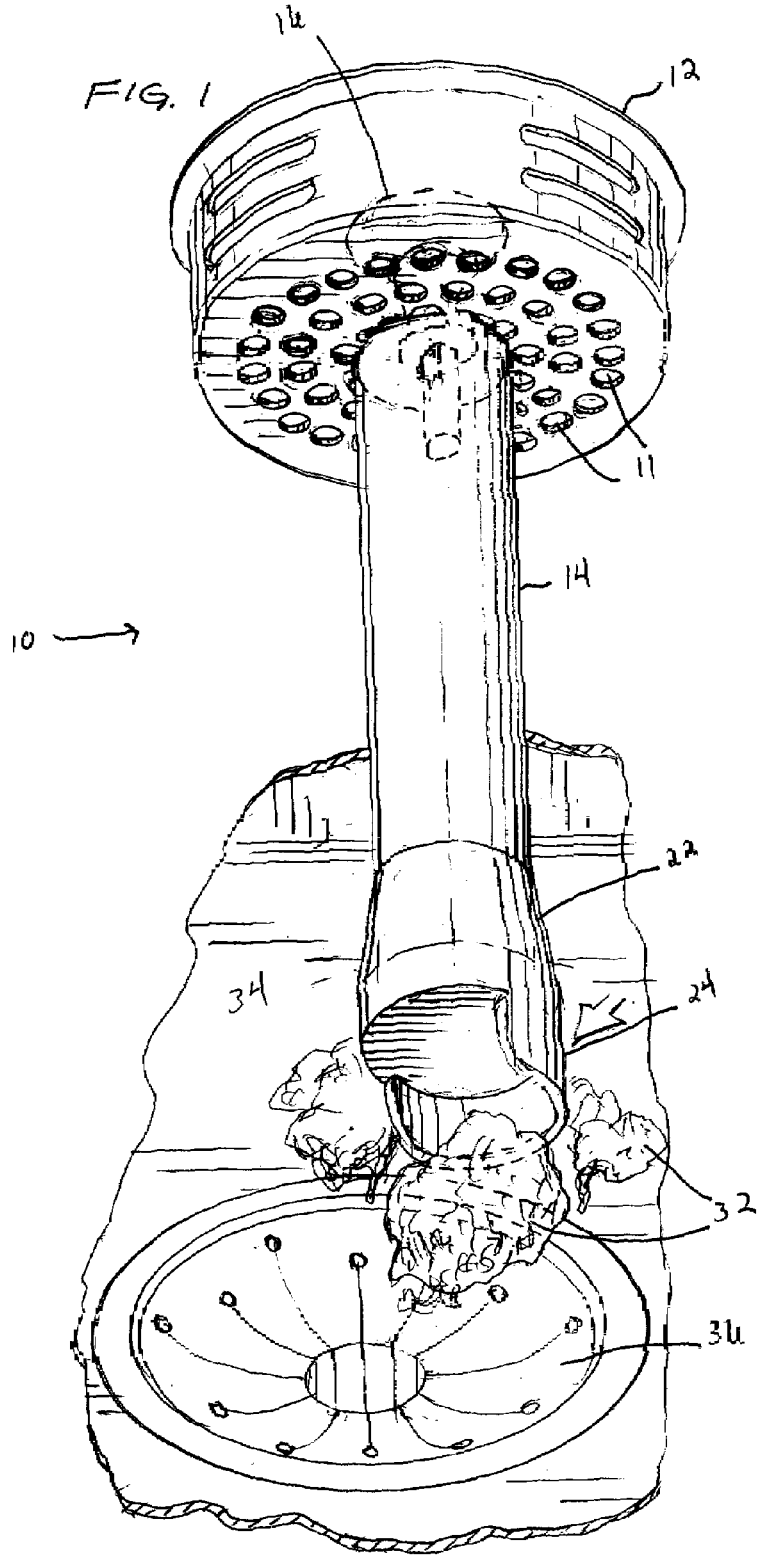
FIG. 1 is a perspective view of the present invention showing the cup-shaped drain, the neck, the flared portion and scraper.

Turning to the drawings, there is shown in FIG. 1 one embodiment of the present invention, a combination garbage disposal safety poker and scraper 10. The safety poker/scraper 10 may have a cup-shaped drain 12 disposed between the neck 14 and the handle 16, capable of forming a seal if the drain 12 is twisted so that the holes 11 in the drain 12 are blocked by a metal piece (not shown) that sits underneath the drain. The safety poker/scraper 10 may also have a handle 16 attached to the top with no drain. The safety poker/scraper may also have a flexible cap 18 with integral handle 20 attached to the top as reflected in FIG. 3.

Figure 2:
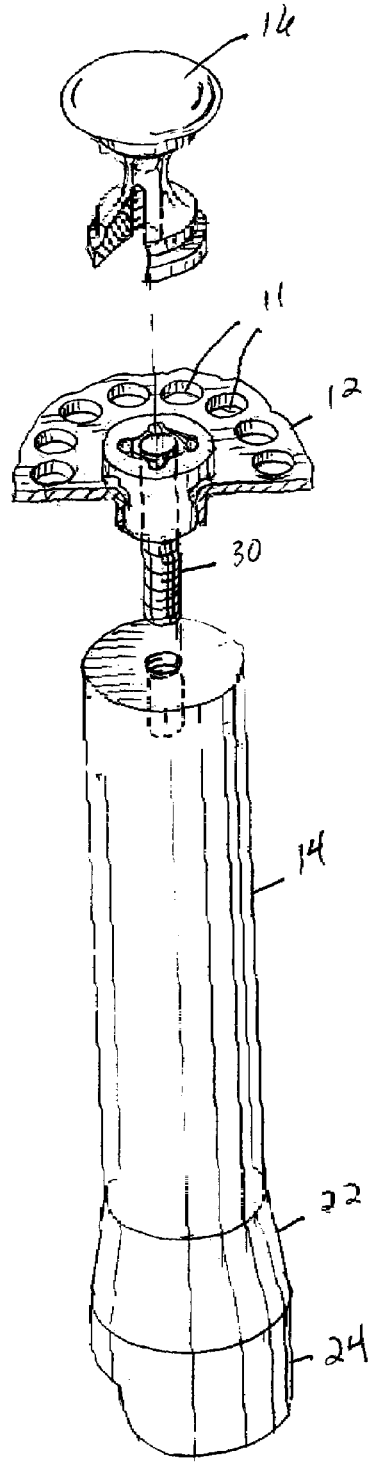
FIG. 2 is a perspective, exploded view of the present invention showing how the handle attaches to the neck.
Figure 3:
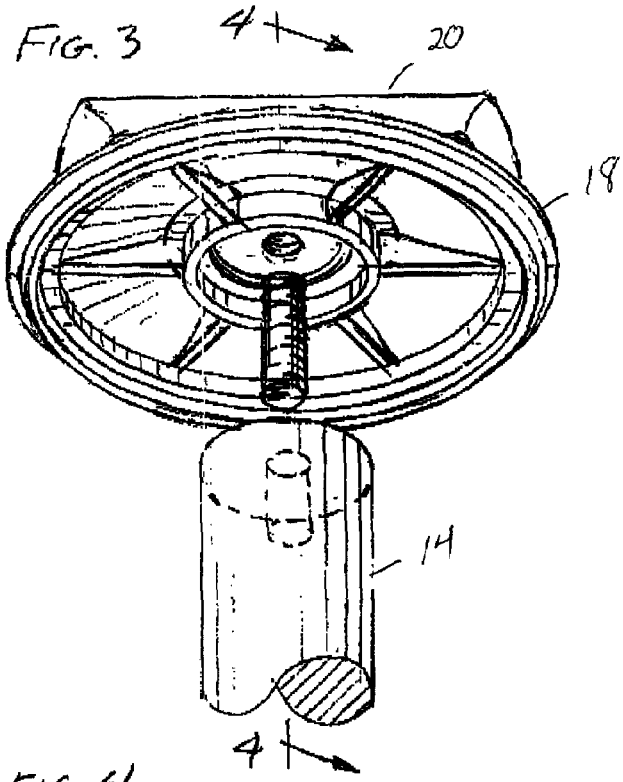
FIG. 3 is perspective view of the present invention showing the alternative elastomeric handle and stopper and how it is secured to the neck by a screw.
Figure 4:
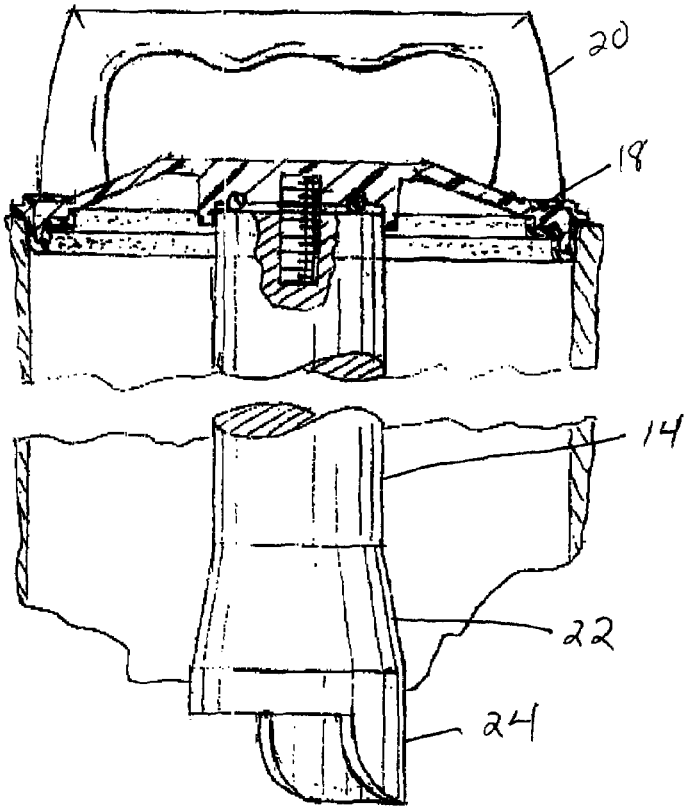
FIG. 4 is a partial cutaway front view of the neck, flared portion and scraper portion of the present invention.
Figure 5:
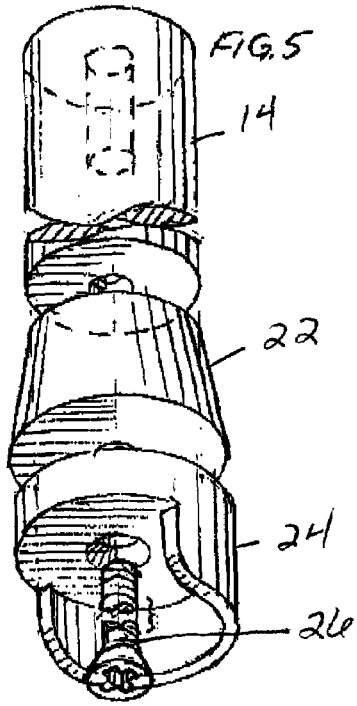
FIG. 5 is a partial perspective exploded view of the neck, flared portion and scraper portion of the present invention showing how the flared portion and the scraper portion are detachable from the bottom of the neck and held together by a screw and how the top portion is secured to the drain/handle by a screw.
Figure 6:
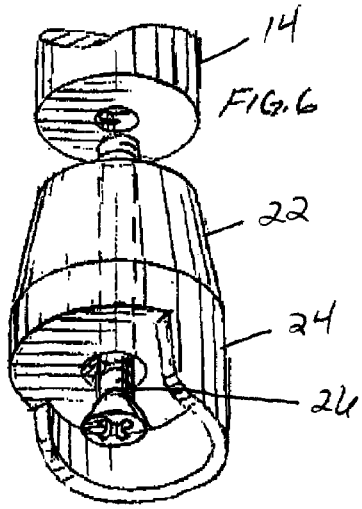
FIG. 6 is a partial perspective view of the neck, flared portion and scraper portion of the present invention showing how the flared portion is detachable from the neck and how a screw holds the pieces together.
Figure 7:
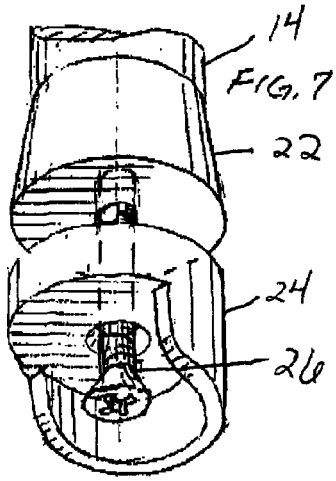
FIG. 7 is a partial perspective view of the flared portion and the scraper portion of the present invention showing how the scraper portion is detachable from the flared portion and how a screw holds the pieces together.

The combination safety poker/scraper 10 comprises at least four pieces, including an elongated, cylindrical neck 14 having a top end and a bottom end, the outwardly flared portion 22, the scraper portion 24 and one of the interchangeable drains/handles attached to the top. As best shown in FIGS. 5 through 7, the flared portion 22 and the scraper portion 24 may be detachable and connected to the bottom end of the neck 14 by a screw 26 that goes in through the bottom of the scraper portion 24. As shown in FIGS. 1 through 3, the handle 16 and/or drain 12 and/or flexible cap 18 may be secured to the top end of the neck 14 by a double edged screw that screws into the neck and the handle and/or drain 28.

The flared portion 22 and scraper portion 24 may be made of a more pliable material than the neck 14. The cap 18 may be made of any elastomeric material.

The invention works in the following manner. The scraper portion 24 is used to collect the food and wastes 32 that gathers in the sink 34. The scraper portion 24 pushes these materials 32 into the garbage disposal. The scraper portion 24 can also be used to scrape food off dishes. Once the safety poker/scraper 10 is in the garbage disposal, it can be pushed down so that the device 10 pushes all waste materials 32 toward the blades of the garbage disposal.

Other modifications and alternative embodiments of the invention are contemplated which do not depart from the scope of the invention as defined by the foregoing teachings and appended claims. It is intended that the claims cover all such modifications that fall within their scope.

I claim:

1. A combination garbage disposal safety poker and scraper for use with a sink drain mounted garbage disposal unit, comprising:

an elongate cylindrical neck having a top end and a bottom end;

a cap and handle detachably affixed to the top end of the neck, said cap capable of forming a fluid tight seal over the sink drain;

an outwardly flared portion extending from the bottom end of the neck, said flared portion having a top end adjacent the neck and a bottom end opposite the flared portion top end; and a scraper portion detachably affixed to the bottom end of the flared portion, the scraper portion being made from a more pliable material than the neck.

2. A combination garbage disposal safety poker and scraper for use with a sink drain mounted garbage disposal unit, comprising:

an elongate cylindrical neck having a top end and a bottom end;

two or more interchangeable handle and drain seal combinations, each of which can be detachably affixed to the top end of the neck and each of which is capable of forming a fluid tight seal over the sink drain;

an outwardly flared portion extending from the bottom end of the neck, said flared portion having a top end adjacent the neck and a bottom end opposite the flared portion top end; and a scraper portion detachably affixed to the bottom end of the flared portion, the scraper portion being made from a more pliable material than the neck.

3. The combination garbage disposal safety poker and scraper of claim 2 wherein one of the handle and drain seal combinations is a cup-shaped drain and a handle, the cup-shaped drain capable of forming a fluid-tight seal if the drain is twisted so that the holes are blocked by a piece of metal that sits directly underneath the drain.

4. The combination garbage disposal safety poker and scraper of claim 2 wherein one of the handle and drain seal combinations is a flexible cap and handle.

* * * * *